US010494222B2

(12) United States Patent
Mazarac

(10) Patent No.: US 10,494,222 B2
(45) Date of Patent: Dec. 3, 2019

(54) COILED TUBING AND SLICKLINE UNIT

(71) Applicant: RADJET SERVICES US, INC., Austin, TX (US)

(72) Inventor: Kevin Mazarac, Houma, LA (US)

(73) Assignee: RADJET SERVICES US, INC., Austin, TX (US)

( * ) Notice: Subject to any disclaimer, the term of this patent is extended or adjusted under 35 U.S.C. 154(b) by 52 days.

(21) Appl. No.: 15/935,322

(22) Filed: Mar. 26, 2018

(65) Prior Publication Data

US 2019/0292008 A1 Sep. 26, 2019

(51) Int. Cl.

*B65H 75/44* (2006.01)
*E21B 19/00* (2006.01)
*E21B 19/22* (2006.01)

(52) U.S. Cl.

CPC ..... *B65H 75/4489* (2013.01); *B65H 75/4478* (2013.01); *E21B 19/008* (2013.01); *E21B 19/22* (2013.01)

(58) Field of Classification Search

CPC ..... E21B 19/22; E21B 19/008; B65H 75/146; B65H 75/4418; B65H 75/4478; B65H 75/4489

USPC ..... 137/355.16–355.28

See application file for complete search history.

(56) References Cited

U.S. PATENT DOCUMENTS 1,914,654 A * 6/1933 Tornblom ..... B65H 75/44 137/355.17
3,165,109 A * 1/1965 Hammelmann ..... E03F 9/00 134/167 C
3,190,307 A * 6/1965 De Vries ..... B65H 75/425 137/355.17
3,709,252 A * 1/1973 Bishop ..... B66F 9/205 137/355.17
3,766,996 A * 10/1973 Moody ..... E21B 19/084 173/197
3,841,407 A 10/1974 Bozeman
(Continued)

FOREIGN PATENT DOCUMENTS

WO 2017146594 A1 8/2017

OTHER PUBLICATIONS

ISR and Written Opinion of ISA dated Jun. 6, 2019, relative to PCT/US2019/023819, which claims priority to the present application.

*Primary Examiner* — Kevin F Murphy
*Assistant Examiner* — Jonathan J Waddy
(74) *Attorney, Agent, or Firm* — Egbert Law Offices, PLLC

(57) ABSTRACT

A coiled tubing unit includes a coiled tubing assembly and a slickline assembly sharing an axis of rotation with the coiled tubing assembly. A shaft of the coiled tubing assembly is received by bearings on a slickline drum of the slickline assembly and extends through an interior of the slickline drum. A swivel joint connection is rotatably affixed on an end of the main shaft as it exits the interior of the slickline drum, thus allowing for introduction of fluid or cabling into the main shaft and into the coiled tubing. The coiled tubing drum and slickline drum can rotate independently and are powered independently of each other. The coiled tubing and slickline assemblies are preferably affixed to a removable module, the removable module being positioned on a skid having a power unit and appropriate controls.

18 Claims, 6 Drawing Sheets

(56) References Cited

U.S. PATENT DOCUMENTS

| | | | | | |
|---|---|---|---|---|---|
| 3,848,685 | A * | 11/1974 | Takagi | E02F 5/02 | 175/206 |
| 4,265,304 | A | 5/1981 | Baugh | | |
| 4,441,561 | A * | 4/1984 | Garmong | E21B 19/22 | 138/89 |
| 4,476,945 | A * | 10/1984 | Hearn | E21B 19/22 | 175/203 |
| 5,568,824 | A * | 10/1996 | Cordrey | B65H 75/38 | 137/334 |
| 5,671,811 | A * | 9/1997 | Head | E21B 17/015 | 166/346 |
| 8,136,587 | B2 | 3/2012 | Lynde et al. | | |
| 8,403,048 | B2 | 3/2013 | Laird et al. | | |
| 9,593,573 | B2 | 3/2017 | Ullah | | |
| 2004/0244993 | A1* | 12/2004 | Crawford | E21B 15/00 | 166/381 |
| 2006/0197073 | A1 | 9/2006 | Studer | | |
| 2008/0218374 | A1 | 9/2008 | Hagen et al. | | |
| 2010/0314132 | A1 | 12/2010 | Coles | | |
| 2011/0005766 | A1 | 1/2011 | Shand | | |
| 2013/0020271 | A1 | 1/2013 | Nero et al. | | |
| 2013/0153227 | A1 | 6/2013 | Laird et al. | | |
| 2013/0309016 | A1 | 11/2013 | McKee et al. | | |
| 2014/0332095 | A1* | 11/2014 | Smit | E21F 16/00 | 137/355.17 |
| 2015/0166148 | A1* | 6/2015 | Liu | B63B 27/24 | 137/15.09 |
| 2015/0233211 | A1 | 8/2015 | Bujold et al. | | |
| 2016/0289052 | A1 | 10/2016 | Sorensen et al. | | |
| 2016/0298398 | A1 | 10/2016 | Orban | | |

* cited by examiner

COILED TUBING AND SLICKLINE UNIT

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the field of coiled tubing systems. More particularly, the present invention relates to a coiled tubing system wherein a coiled tubing assembly is positioned adjacent a slickline assembly such that the assemblies share an axis of rotation.

2. Description of Related Art Including Information Disclosed Under 37 CFR 1.97 and 37 CFR 1.98

Coiled tubing systems for well operations are generally known. In such systems, a continuous tubing, typically fabricated from metal, is driven down into the well by means of an injector head, which consists of a pair of continuous-chain gripping dog assemblies which grip the tubing and drive it down into the well with the aid of two motors. Reverse operation of the chain dog assemblies is used to pull the tubing from the well.

On the surface, the tubing is stored on a large drum or reel from which the tubing is withdrawn by the pull of the injector head. The reel is motor-driven to allow for reloading of the tubing onto the drum as it is withdrawn from the well.

A level-wind is used to guide the tubing string off/onto the drum in an orderly manner to maximize the length of tubing which the drum can accommodate.

For applications where coiled tubing operations are to be carried out at shallow well depths and the wells are considered "dead" (i.e., well fluid hydrostatic pressure exceeds the formation pressure) there is no requirement for an injector due to the weight of the coiled tubing string in the well exceeding the buoyancy factor of the general wellbore fluid.

The basic coiled tubing equipment (reel, fluid pump and tubing guide) are of very similar design across all service providers working within the field of well intervention within the industry. Service providers tend to supply these pieces of equipment separately to maximize the capacity or capability of each unit given that weight restrictions may apply when moving equipment with cranes.

Coiled tubing reels tend to be provided on their own in skid form or on the back of a trailer. Fluid pumps likewise tend to be supplied on a skid of their own or on a trailer.

Various patent have issued in the past related to coiled tubing units. For example, U.S. Pat. No. 3,841,407, issued on Oct. 15, 1974 to Bozeman, teaches such a coiled tubing unit. In this patent, an apparatus and method are disclosed for running coiled tubing into a well wherein the coiled tubing is pulled from a reel by a feeding unit which includes opposed roller chains moving along an arcuate path formed by a frame. One of the roller chains is powered and provided with gripping elements for gripping the tubing, and the other roller chain is pressed into engagement with the tubing by fluid pressure in a hose. The hose provides a uniform pressure along the arcuate path, and the tube is straightened at the outlet of the arcuate path by a straightening device.

U.S. Pat. No. 4,265,304, issued on May 5, 1981 to Baugh. This patent discloses a coiled tubing apparatus for operating on wells, wherein a tubing injector head is supported on a mast and movable to selected elevations along the mast. The mast includes a lower section and an upper section which is pivotally joined the lower section. The injector head may be lowered below the pivot point and the mast folded for transportation purposes.

Slickline is another important tool for well operations, and is generally well-known. Slickline is raised and lowered in the well by hydraulically reeling in and out a wire, and is generally requested in addition to a coiled tubing unit, as it is much simpler and quicker to deploy where non-pumping operations are required.

Slickline can be used for a number of purposes within a well, as disclosed in various patents related to slickline. For example, U.S. Patent Publication No. 2013/0153,227, published on Jun. 20, 2013 discloses the use of slickline to run a motor-driven mill the within a well.

U.S. Pat. No. 8,136,587, issued on Mar. 20, 2012 to Lynde et al., discloses the use of slickline with a tubular scraper system. The downhole tubular scraper of this patent is run on slickline with an onboard power supply, and features counter-rotating scrapers with an anchor or an anchor with single rotating scrapers.

U.S. Pat. No. 8,403,048, issued on Mar. 26, 2013 to Laird et al., teaches the use of slickline to drive a tubing cutter. The tubing cutter is run in with a bottom hole assembly that includes a seal and support within the tubing to be cut.

U.S. Pat. No. 9,593,573, issued on Mar. 14, 2017 to Ullah, discloses fiber-optic slickline and tools associated therewith. The fiber-optic slickline enables communication with various downhole tools and tool assemblies configured to communicate via the fiber-optic slickline. This slickline can be used in logging and other downhole operations and provides real-time communication with surface equipment.

It is an object of the present invention to provide an apparatus wherein coiled tubing and slickline reels are combined into a single unit.

It is another object of the present invention to provide a combined coiled tubing and slickline unit which reduces potential hazards associated with transportation and lifting.

It is another object of the present invention to provide a coiled tubing and slickline unit which reduces equipment footprint on a well site.

It is another object of the present invention to provide a combined coiled tubing and slickline unit which requires less personnel on site.

It is yet another object of the present invention to provide a combined coiled tubing and slickline unit wherein there are no external removable hydraulic hoses required to connect the fluid pump and power pack to the various reels.

It is another object of the present invention provide a combined coiled tubing and slickline unit wherein both the coiled tubing and slickline drums are aligned with the wellhead.

It is another object of the present invention provide a combined coiled tubing and slickline unit wherein a single power pack provides power for both units such that there is no required disconnect to switch from powering one unit the other.

It is another object of the present invention to provide a combined coiled tubing and slickline unit wherein a coiled tubing and slickline module can be quickly switchable so as to change the coil tubing and/or slickline sizes.

It is another object of the present invention provide a modular assembly which allows for various uses of coiled tubing and/or slickline drums.

These and other objects and advantages of the present invention will become apparent from a reading of the attached specification and appended claims.

BRIEF SUMMARY OF THE INVENTION

One embodiment of the present invention is an apparatus having a base, a coiled tubing assembly affixed to the base and a slickline assembly affixed to the base. The coiled tubing assembly has a coiled tubing reel mounted on a shaft. The slickline assembly has a slickline drum and at least one bearing unit. The shaft of the coiled tubing assembly is received by the at least one bearing unit so as to pass through the interior of the slickline drum such that the coiled tubing drum is rotatable independently of the slickline drum.

In an embodiment of the present invention, the coil tubing assembly and the slickline assembly have a common axis of rotation.

In an embodiment, the apparatus further includes a skid, wherein the base is removably positioned on the skid. The skid may have a power unit positioned thereon. The power unit preferably has an engine and at least a first hydraulic pump and a second hydraulic pump. A first motor may be positioned on the base and connected to the coiled tubing assembly. The first motor is connected to the first hydraulic pump via a first hydraulic hose. A second motor may be positioned on the base and connected to the slickline assembly. The second motor is connected to the second hydraulic pump via a second hydraulic hose.

A fluid pump may be positioned on the skid. The fluid pump preferably has a third motor connected thereto. The third motor is connected to third hydraulic pump of the power unit by a third hydraulic hose.

In an embodiment, the shaft of the coiled tubing assembly has an end extending outwardly of the slickline drum. In this embodiment, a fluid hose connection is mounted on the end of the shaft and is rotatable relative to the shaft. A hole is drilled through the shaft in a location between first and second reel flanges of the coiled tubing drum. Preferably, the shaft of the coiled tubing assembly has an interior passageway between the hole and the fluid hose connection.

In an embodiment, the slickline assembly has a level-wind assembly positioned adjacent thereto.

Preferably, a control cab is positioned on the skid.

The present invention is also an apparatus having a skid with a power unit positioned thereon, and a module removably positioned thereon. The power unit has an engine, a first hydraulic pump and a second hydraulic pump. The module has a primary reel assembly with a first motor and a secondary reel assembly with a second motor. The primary reel assembly and secondary reel assembly having a have a common axis of rotation and are independently rotatable. The first motor is connected to the first hydraulic pump via a first hydraulic hose. The second motor is preferably connect the second hydraulic pump via a second hydraulic hose.

In an embodiment, the skid preferably has controls positioned thereon adapted to operate the power unit, the primary reel assembly and secondary reel assembly. The controls are preferably located in a control cab positioned on the skid.

In an embodiment, the primary reel assembly has a shaft and a drum. The secondary reel assembly has a drum with at least one bearing unit. The shaft of the primary reel assembly is received by the bearing unit of the secondary reel assembly and extends through an interior of the drum of the secondary reel assembly. Preferably, a fluid hose connection is mounted on the shaft on a side of the secondary reel assembly opposite the primary reel assembly. The fluid hose connection is rotatable relative to the shaft. A hole is also drilled through the shaft in a location between first and second reel flanges of the drum of the primary reel assembly.

In an embodiment, the skid has a fluid pump positioned thereon, the fluid pump being adapted to supply a fluid to the primary reel assembly through the fluid hose connection and the hole.

Preferably, the primary reel assembly is a coiled tubing reel assembly, and the secondary reel assembly is a slickline reel assembly.

The present invention is also a coiled tubing unit having a base, a coiled tubing assembly affixed to the base, a secondary drum positioned adjacent the coiled tubing assembly and a swivel connection. The coiled tubing assembly has a coiled tubing drum with opposing flanges and a shaft. The shaft extends through an interior of the coiled tubing drum and has a hole drilled therein in a position between the opposing flanges of the coiled tubing drum. The secondary drum is positioned adjacent the coiled tubing assembly such that the secondary drum and the coiled tubing drum share an axis of rotation. The secondary drum has at least one bearing unit. The shaft of the coiled tubing assembly is received by the at least one bearing unit and extends through an interior of the secondary drum. The swivel connection is affixed to an end of the shaft adjacent the secondary drum. The swivel connection is rotatable relative to the shaft and is adapted to allow for introduction of a fluid or cable into a hollow interior of the shaft.

Preferably, each of the coiled tubing assembly and secondary drum have a respective motor connected thereto and positioned on the base. The coiled tubing unit also includes a skid having a hydraulic power unit thereon. The base is positioned to the skid. The hydraulic power unit has a first hydraulic hose connected to the motor of the coiled tubing assembly and a second hydraulic hose is connected to the motor of the secondary drum. Preferably, the base is removably affixed to the skid.

Preferably, the secondary drum is a slickline drum.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
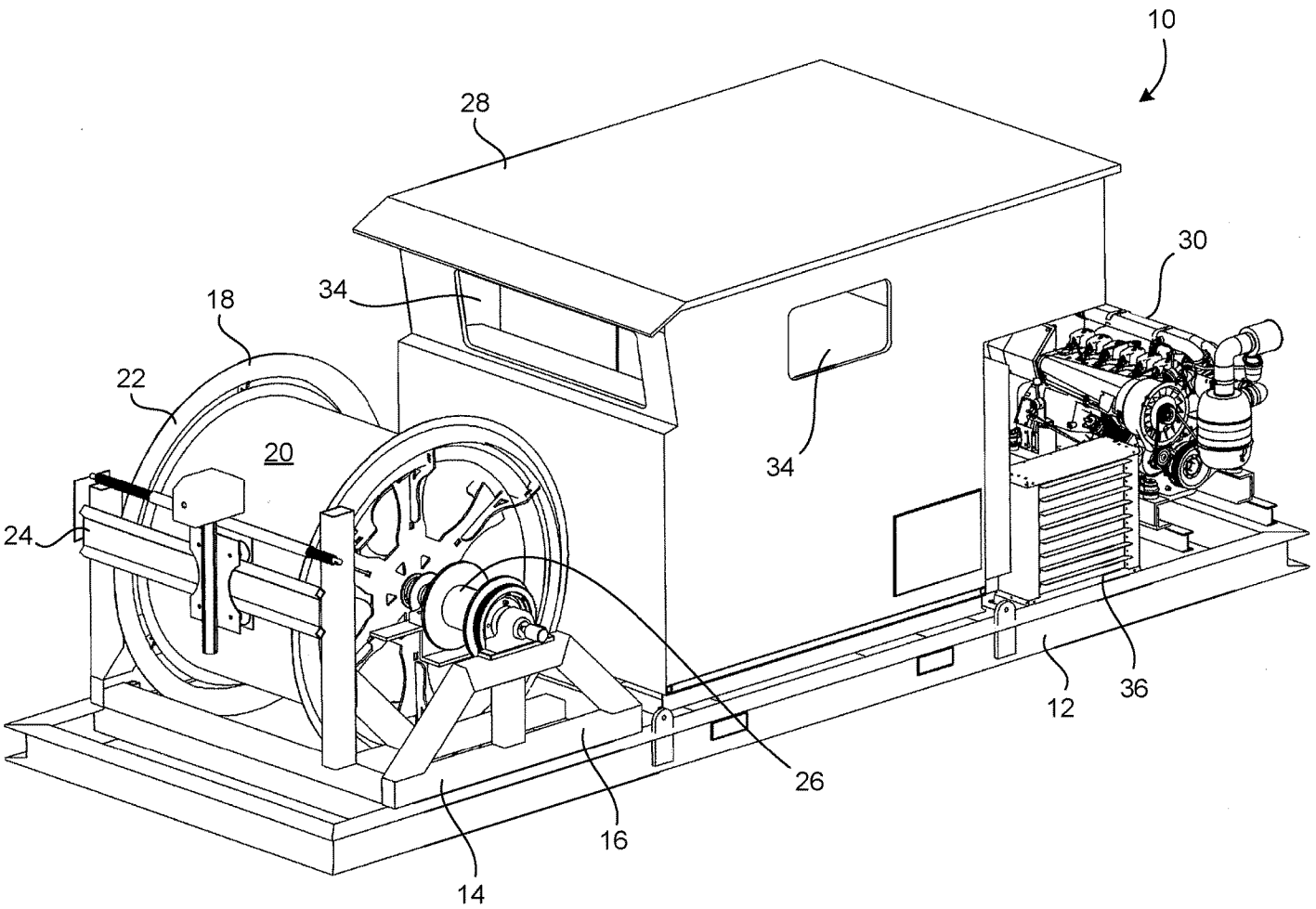
FIG. 1 is a perspective view of the coiled tubing and slickline unit of the preferred embodiment of the present invention.
Figure 2:
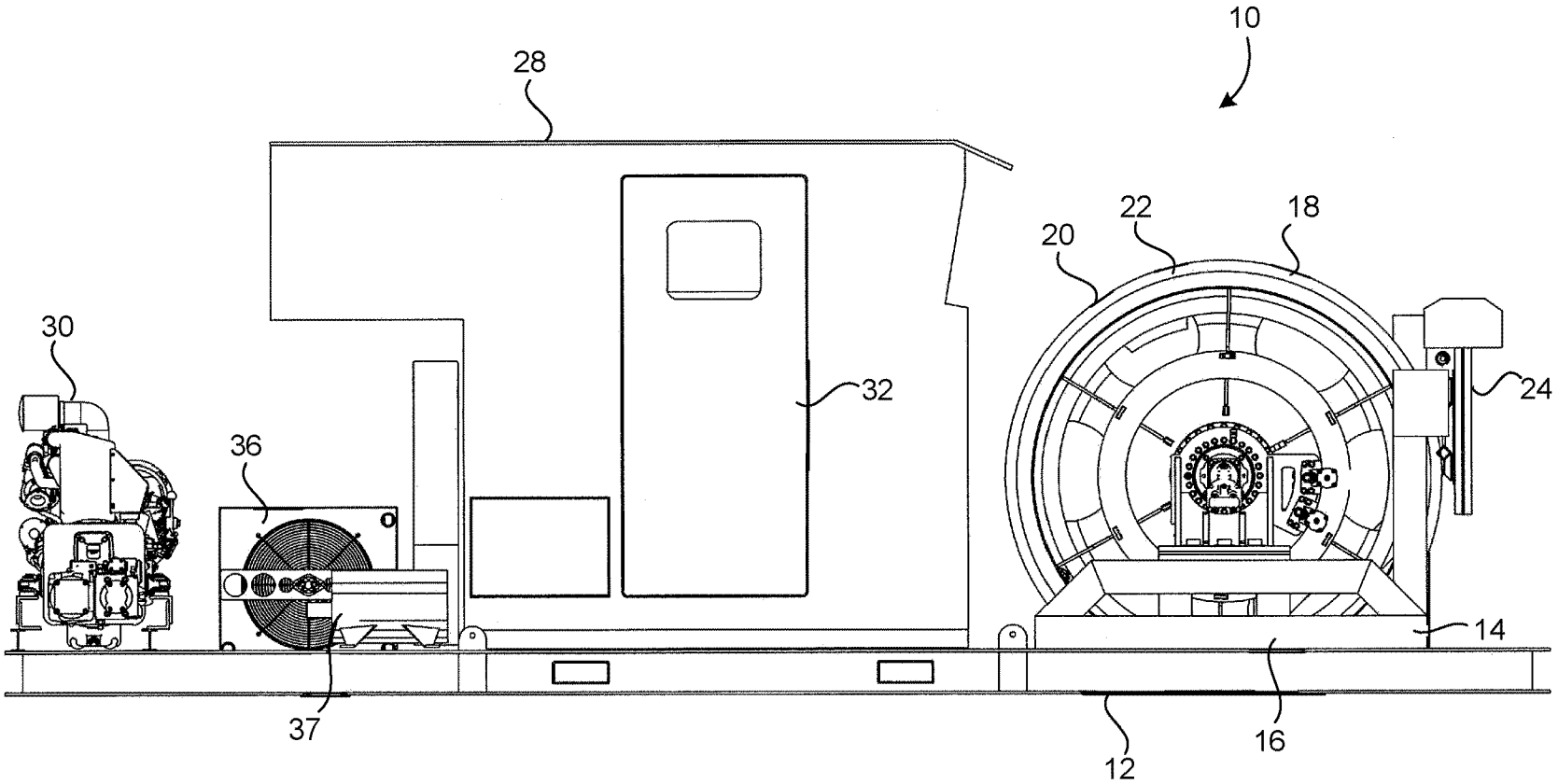
FIG. 2 is a side view of the coiled tubing and slickline unit of the preferred embodiment of the present invention.

Referring to FIGS. 1 and 2, there is shown the coiled tubing and slickline unit 10 in accordance with the preferred embodiment of the present invention. The coiled tubing and slickline unit 10 includes a skid 12 having a generally rectangular frame. The skid 12 supports a slickline and coiled tubing module 14 at one end thereof. Preferably, the slickline and coiled tubing module 14 is removably positioned on the skid 12. The skid 12 and module 14 are adapted to be transported by conventional means, including forklifts and slings.

The slickline and coiled tubing module 14 has a base 16 supporting a primary reel assembly 18 and a secondary reel assembly 26. In the preferred embodiment of the present invention, the primary reel assembly 18 is in the form of a coiled tubing assembly 18, while the secondary reel assembly 26 is in the form of a slickline assembly 26, each being referred to hereinafter as such. It is within the concept of the present invention that the various tubing or reel assemblies could take the form of different types of tubing or reel assemblies usable in well operations or other similar operations.

The coiled tubing assembly 18 is shown as having a coiled tubing drum 20 with a pair of coiled tubing reel flanges 22. A coiled tubing level-wind 24 is shown positioned in front of the coiled tubing drum 20, and serves to assist in the winding of the coiled tubing (not shown) onto and off of the coiled tubing drum 20. The slickline assembly 26 is shown in more detail hereinbelow.

Preferably, the skid 12 has a control cab 28 with suitable controls therein for controlling the coiled tubing assembly 18, slickline assembly 26 and related motors and pumps. The control cab 28 is illustrated as having an access door 32 and windows 34. The control cab serves as a central location for controls, thus requiring less personnel to operate, as compared to the prior art where coiled tubing and slickline are provided on separate units having separate power supplies.

A power unit 30 is shown as positioned on the skid 12 at an end thereof opposite the assemblies 18 and 26. Positioned adjacent the power unit 30 is a hydraulic radiator 36 for cooling hydraulic fluid from hydraulic pumps, which are described below.

A high-pressure fluid pump 37 is illustrated in FIG. 2, and can be used for jetting within the well. This fluid pump 37 is connected to the coiled tubing assembly 18 as will be described below. Fluid pumps are traditionally supplied separately from coiled tubing units.

Figure 3:
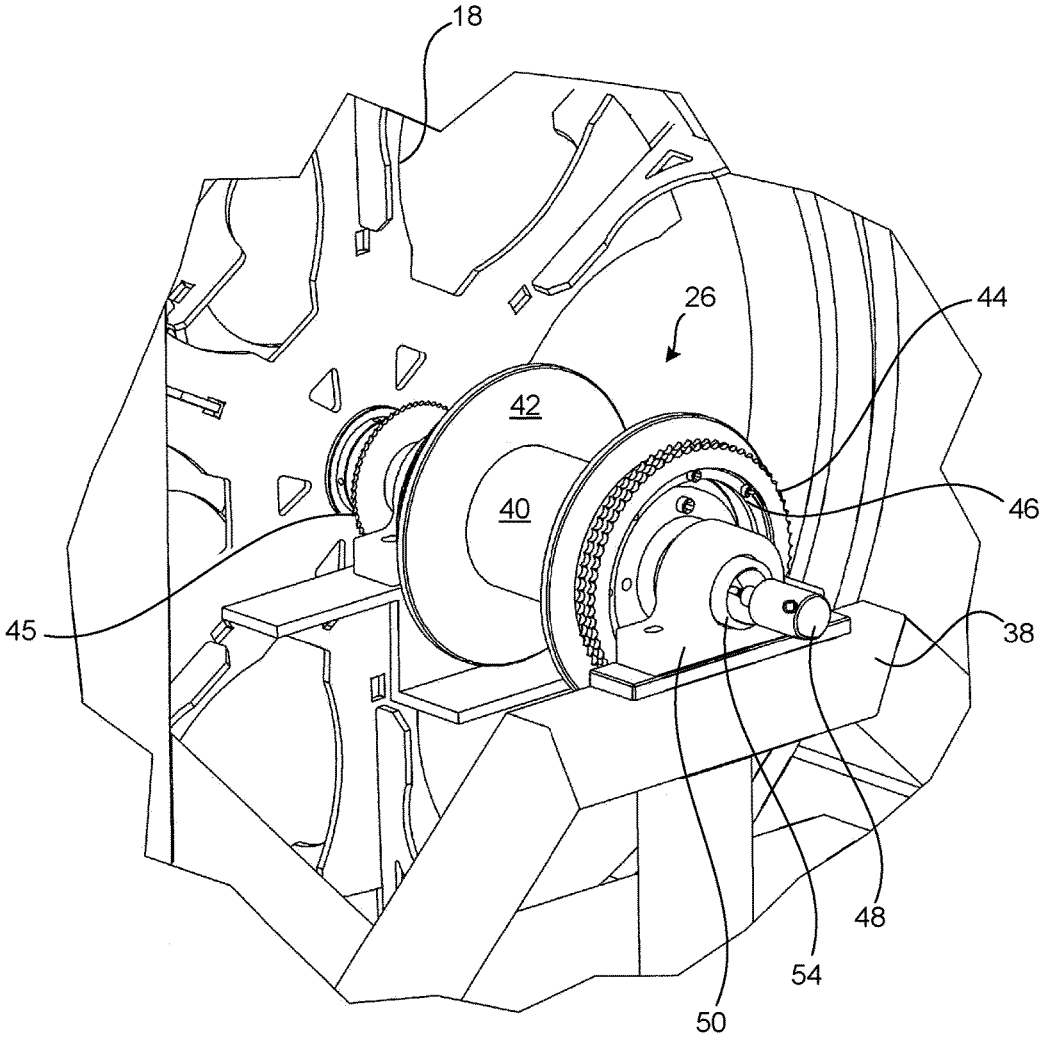
FIG. 3 is an isolated view focusing on the slickline assembly of the preferred embodiment of the present invention.

Referring to FIG. 3, there is shown an isolated view adjacent the slickline assembly 26. In FIG. 3, it can be seen that a support frame 38 is provided at one end of the slickline assembly 26, which serves to support the slickline drum 40 vertically above the base 16 of the slickline and coiled tubing module 14. The slickline drum 40 is illustrated as having a pair of slickline drum flanges 42. A chain sprocket 44 is illustrated on one side of the slickline drum 40. The chain sprocket 44 receives a chain (not shown) from a dedicated motor (described below) which serves to independently drive the slickline assembly 26.

A second chain sprocket 45 is shown in FIG. 3. The second chain sprocket 45 receives a chain (not shown) and is used to operate the level-wind 24 from the turning of the coiled tubing drum 20.

Importantly, FIG. 3 illustrates the slickline reel bearings 46. At least one slickline reel bearing unit 46 is provided on the slickline drum 40. However, in the preferred embodiment of the present invention, a slickline reel bearing unit 46 is provided at both ends of the slickline drum 40 adjacent the slickline drum flanges 42. The slickline reel bearing units 46 receive the main shaft 54 of the coiled tubing assembly 18. Importantly, the main shaft 54 runs through the interior of the slickline drum 40 but is not rigidly connected to it. This allows the coiled tubing drum 20 and the slickline drum 40 to rotate independently of one another.

Figure 4:
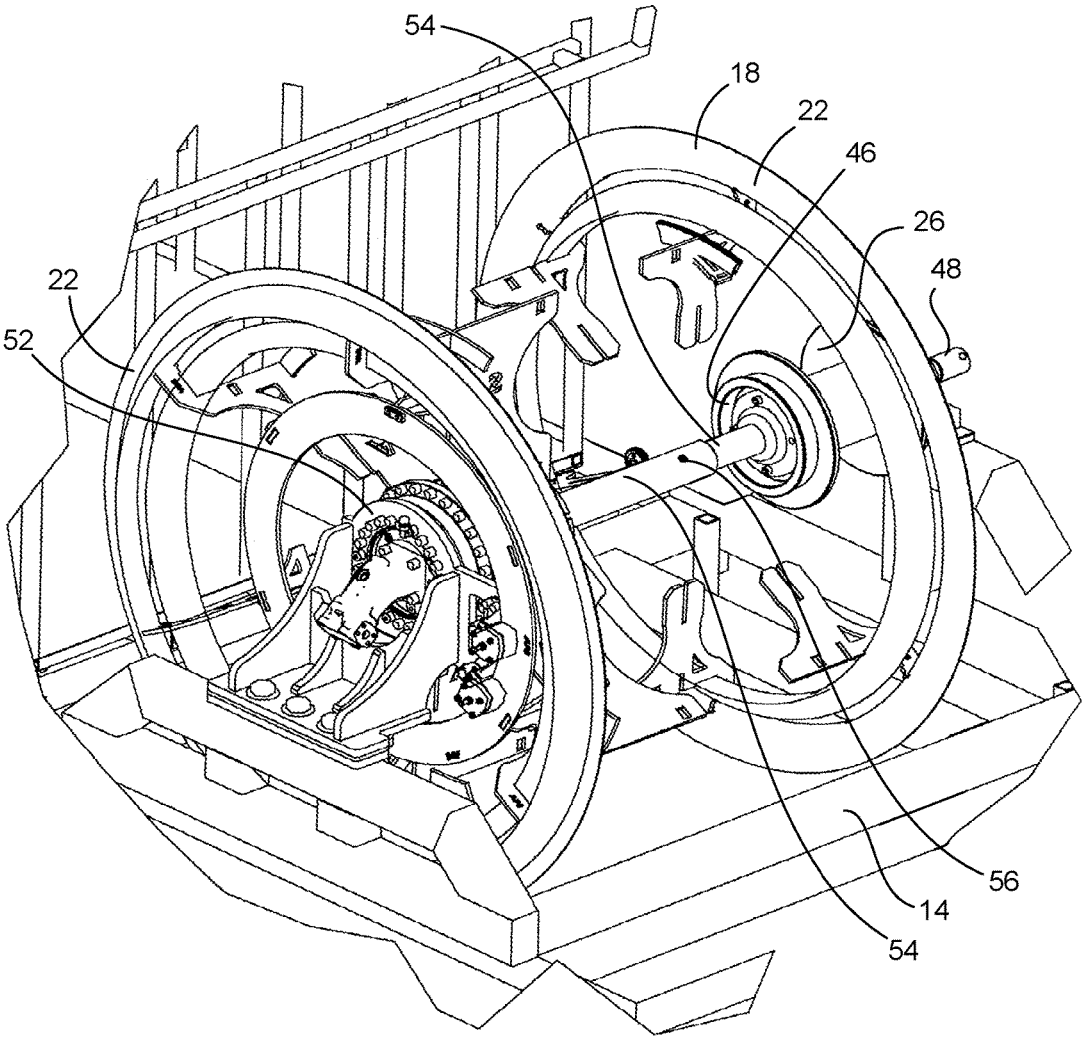
FIG. 4 is isolated view of the coiled tubing and slickline assemblies of the unit of the present invention, wherein various components of the coiled tubing unit have been removed for clarity.

In FIG. 3, it can be seen how a portion of the shaft 54 extends outwardly of a support 50. FIG. 3 also importantly illustrates the swivel joint fluid hose connection 48. This connection 48 can rotate relative to the main shaft 54, and is utilized introduce a fluid or a cable therethrough and into an interior passageway of the main shaft 54 so as to communicate with a drilled hole (as shown in FIG. 4) drilled through the main shaft 54. Preferably, the swivel joint fluid hose connection 48 is rotatable by a set of bearings mounted on the main shaft 54.

Referring to FIG. 4, there is shown an isolated view of the coiled tubing and slickline assemblies 18 and 26, wherein various components of the coiled tubing assembly 18 and slickline assembly 26, most notably the surface of the coiled tubing drum 20, are not shown so as to better illustrate the workings of the present invention.

Shown in FIG. 4 is the coiled tubing reel motor and gearbox 52 positioned on one end of the coiled tubing assembly 18 opposite the slickline assembly 26. The coiled tubing reel motor and gearbox 52 are powered by hydraulic hoses (not shown) and serve to turn the coiled tubing drum 20 at a desired speed.

FIG. 4 also illustrates how the main shaft 54 extends through an interior of the coiled tubing assembly 18 and is received by the slickline reel bearing 46. While the main shaft 54 is illustrated as having two different outer diameters, the main shaft 54 can have a constant outer diameter along the entire length thereof. There is also shown the drilled hole 56 in the main shaft 54 between the opposing reel flanges 22 of the coiled tubing assembly 18. The drilled hole 56 is in fluid communication with the interior of the main shaft 54, and also with the swivel joint fluid hose connection 48 positioned on the main shaft 54 opposite the slickline assembly 26.

Figure 5:
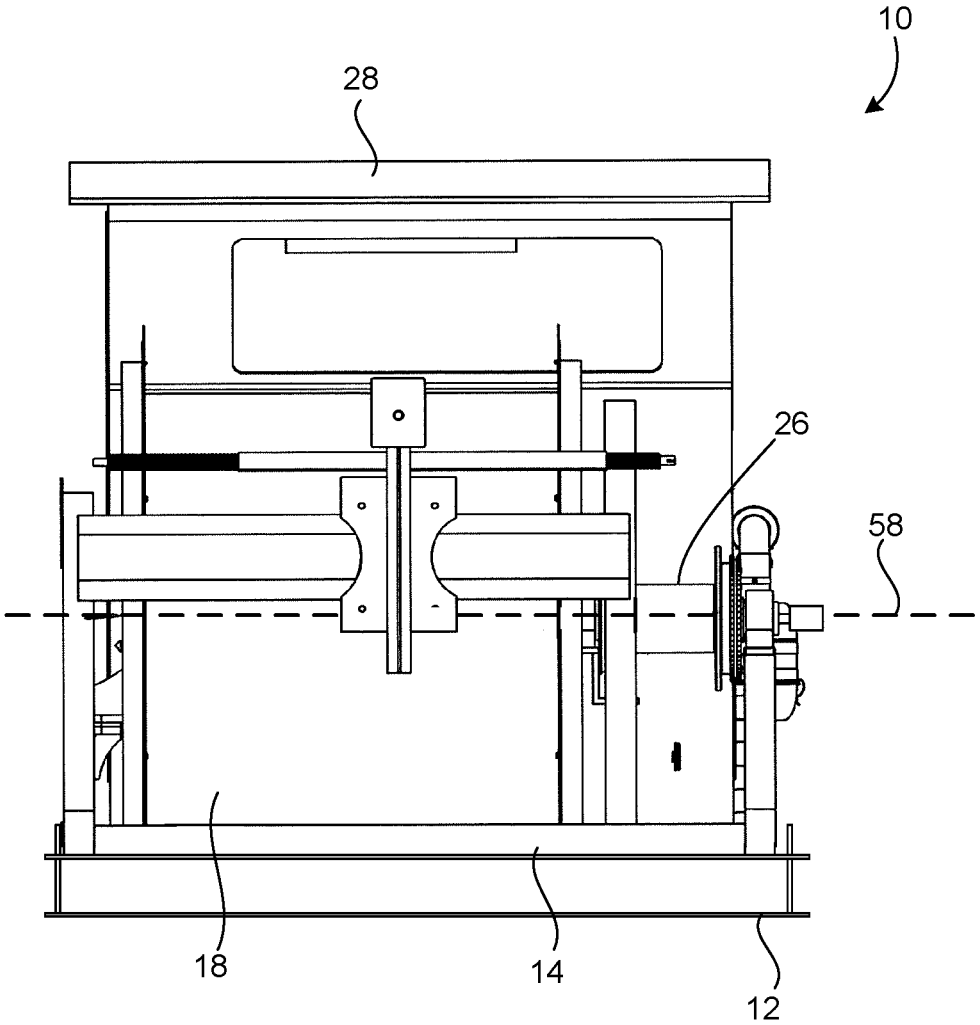
FIG. 5 is a front view of the coiled tubing and slickline unit of the present invention.

Referring to FIG. 5, there is shown a front view of the coiled tubing and slickline unit 10 of the present invention. In FIG. 5, it can be seen how the coiled tubing assembly 18 and slickline assembly 26 share an axis of rotation 58. Such a configuration allows for both reel assemblies 18 and 26 to be aligned with the wellhead, which is a significant advantage as compared to the prior art, wherein the coiled tubing and slickline assemblies are separate units which must be positioned on-site.

Figure 6:
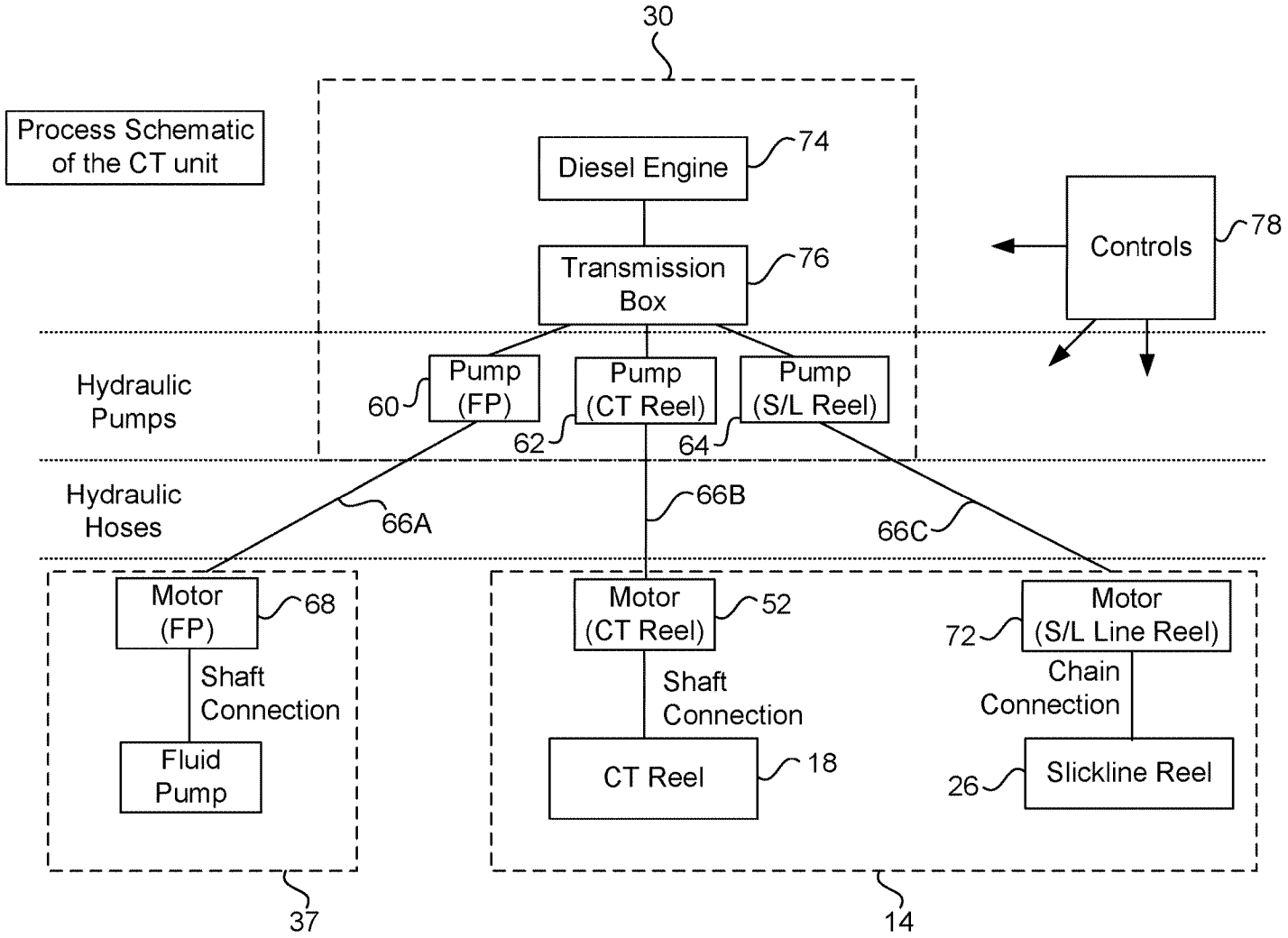
FIG. 6 is a schematic view illustrating the various components of the coiled tubing and slickline unit of the present invention.

FIG. 6 shows a schematic view of the various components of the coiled tubing and slickline unit 10 of the present invention. FIG. 6 particularly illustrates the slickline and coiled tubing module 14, the power unit 30 and the fluid pump 37.

The slickline and coiled tubing module 14 is shown as including the coiled tubing assembly 18 and the slickline assembly 26. A motor 52 for the coiled tubing assembly 18 is shown as having a shaft connection between the motor 52 and the coiled tubing assembly 18. Similarly, there is another motor 72 shown having a chain connection to the slickline reel assembly 26.

The high-pressure fluid pump 37 is shown as having a motor 68 with a shaft connection thereto. The fluid pump 37 supplies water or other fluid through a hose to the coiled tubing assembly 18.

FIG. 6 shows how the power unit 30 has an engine 74 (preferably diesel) connected via a transmission box 76 to a plurality of hydraulic pumps. These hydraulic pumps include a hydraulic pump 60 connected to the motor 68 of the high-pressure fluid pump 37 via a hydraulic hose 66*a*. Similarly, a hydraulic pump 62 is connected by hydraulic hose 66*b* to the coiled tubing motor 52. Finally, a pump 64 is connected via hydraulic hose 66*c* to the slickline motor 72. These hydraulic hoses 66*a*, 66*b* and 66*c* extend from the power unit 30 through the skid 12 so as to be connected to the fluid pump 37 on the skid 12, and to the respective motors on the slickline and coiled tubing module 14. The hydraulic hoses 66*a*, 66*b* and 66*c* can be quickly disconnected from the various components such that the slickline and coiled tubing module 14 can be changed out for another unit, if necessary or desired. The hydraulic hoses 66*a*, 66*b* and 66*c* are preferably safely run through the skid 12 so as to prevent tripping hazards associated with the separate coiled tubing and slickline units and their respective motors and pumps of the prior art.

Suitable controls 78, illustrated in FIG. 6, are preferably located in the control cab 28 of the coiled tubing and slickline unit 10, and are used to control the various motors and pumps of the present invention. Consolidation of these controls 78 represents a significant advancement over the prior art, wherein separate systems for the coiled tubing, slickline and fluid pumps are required.

Introduction of fluid to the coiled tubing assembly presents particular challenges when combining the coiled tubing assembly with the slickline assembly. In normal coiled tubing drums, there are few issues, as the gearing system is on one side of the reel, and the fluid enters the reel on the other side by means of a coiled tubing swivel joint. A coiled tubing swivel joint turns through 360° on bearings that allows fluid entry to the reel.

In the present invention, the slickline assembly is positioned on the side of the coiled tubing assembly opposite the gearing system of the coiled tubing assembly, so as to accomplish the objectives of the present invention wherein: (1) the coiled tubing and slickline drums are aligned with the wellhead; and (2) the coiled tubing and slickline assemblies are placed on a single module which can be easily changed out on the skid. So as to allow introduction of the fluid (or electrical cable) into the coiled tubing assembly, the main shaft 54 of the coiled tubing assembly was developed to run through the center of both reels and extend past the slickline reel without affecting the rotation of the slickline reel.

One of the unique aspects of the present invention is the relative ease with which the slickline and coiled tubing module 14 can be changed out. Various circumstances arise during well operations which require changing a coiled tubing string. For example, it may be necessary or desirable to change the tubing size being utilized. Often, it is also necessary to a re-string a coiled tubing unit which takes a considerable amount of time. In some cases, it may be desirable to have an unstrung coiled tubing or slickline unit so as to utilize the unit to recover and re-spool tubing or other cable or wire that is sheared in a well. With the present invention, to change out the coiled tubing unit (for size or other purposes), operators simply need to remove the slickline and coiled tubing module 14 after disconnecting the hydraulic hoses connected thereto. The module will then be replaced with another module and the hydraulic hoses connected.

As previously noted, within the concept of the present invention, the reels can comprise a primary reel and a secondary reel. In certain circumstances, the slickline or coiled tubing reels (i.e. primary and secondary reels) can be used for less-conventional applications. For example, an electrical base type module can be utilized. In this application, a power or data cable can extend between the swivel-joint connection 48 and drilled hole 56, instead of a fluid. In this example, the larger primary reel can be used to hold electric line cable or electric-line coiled tubing instead of the traditional capillary tubing.

The module 14 can also be used as a cable-pulling unit. In this application, pulling cable is added to the primary reel and can be used for equipment pulling purposes in the field. Possible uses include pulling items across rivers or muddy low spots in environments in which regular vehicles cannot work.

The module 14 can also be used for retrieving lost cable in a well or as a storage unit when needing to retrieve cable or other strings, such as capillary tubing, slickline and rubber hoses, etc. The unit could also be moved to a field location to transfer cables, tubing, etc. onto other devices or units at a controlled rate and with controlled force and tension. The unit of the present invention can hold a back pressure force tension on cable as a crane is applying the cable to its crane drum.

As can be appreciated from a review of the specification and drawings, the modular nature of the present invention can save both time and money on the well site, as well as reduce the possibility of injury to workers on the site.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a base;

a coiled tubing assembly affixed to said base, said coiled tubing assembly having a coiled tubing drum and a shaft; and a slickline assembly affixed to said base, said slickline assembly having a slickline drum and at least one bearing unit, said shaft of said coiled tubing assembly being received by said at least one bearing unit so as to pass through an interior of said slickline drum such that said coiled tubing drum is rotatable independently of said slickline drum.

2. The apparatus of claim 1, said coiled tubing assembly and said slickline assembly having a common axis of rotation.

3. The apparatus of claim 1, further comprising:

a skid, said base being removably positioned on said skid.

4. The apparatus of claim 3, further comprising:

a control cab positioned on said skid.

5. The apparatus of claim 3, further comprising:

a power unit positioned on said skid, said power unit having an engine and at least a first hydraulic pump and a second hydraulic pump;

a first motor positioned on said base and connected to said coiled tubing assembly, said first motor being connected to said first hydraulic pump via a first hydraulic hose; and a second motor positioned on said base and connected to said slickline assembly, said second motor being connected to said second hydraulic pump via a second hydraulic hose.

6. The apparatus of claim 5, further comprising:

a fluid pump positioned on said skid, said fluid pump having a third motor connected thereto, said third motor connected to a third hydraulic pump of said power unit via a third hydraulic hose.

7. The apparatus of claim 1, said shaft of said coiled tubing assembly having an end extending outwardly of said slickline drum, the apparatus further comprising:

a fluid hose connection mounted on said end of said shaft, said fluid hose connection being rotatable relative to said shaft; and a hole drilled through said shaft in a location between first and second reel flanges of said coiled tubing drum.

8. The apparatus of claim 7, said shaft of said coiled tubing assembly having an interior passageway extending between said hole and said fluid hose connection.

9. The apparatus of claim 1, said slickline assembly having a level-wind assembly positioned adjacent thereto.

10. An apparatus comprising:

a skid having a power unit positioned thereon, said power unit having an engine, a first hydraulic pump and a second hydraulic pump;

a module removably positioned on said skid, said module having a primary reel assembly with a first motor and a secondary reel assembly with a second motor, said primary reel assembly being a coiled tubing reel assembly, said secondary reel assembly being a slickline reel assembly, said primary reel assembly and said secondary reel assembly having a common axis of rotation and being independently rotatable, said first motor being connected to said first hydraulic pump via a first hydraulic hose, said second motor being connected to said second hydraulic pump via a second hydraulic hose.

11. The apparatus of claim 10, said skid having controls positioned thereon, said controls adapted to operate said power unit, said primary reel assembly and said secondary reel assembly.

12. The apparatus of claim 11, said controls being located in a control cab positioned on said skid.

13. The apparatus of claim 10, said primary reel assembly having a shaft and a drum, said secondary reel assembly having a drum with at least one bearing unit, said shaft of said primary reel assembly being received by said at least one bearing unit of said secondary reel assembly and extending through an interior of said drum of said secondary reel assembly.

14. The apparatus of claim 13, further comprising:

a fluid hose connection mounted on said shaft on a side of said secondary reel assembly opposite said primary reel assembly, said fluid hose connection being rotatable relative to said shaft; and a hole drilled through said shaft in a location between first and second reel flanges of said drum of said primary reel assembly.

15. The apparatus of claim 14, said skid having a pump positioned thereon, said pump being adapted to supply a fluid to said primary reel assembly through said fluid hose connection and said hole.

16. A coiled tubing unit comprising:

a base;

a coiled tubing assembly affixed to said base, said coiled tubing assembly having a coiled tubing drum with opposing flanges and a shaft, said shaft extending through an interior of said coiled tubing drum and having a hole drilled therein in a position between said opposing flanges of said coiled tubing drum;

a slickline drum positioned adjacent said coiled tubing assembly such that said slickline drum and said coiled tubing drum share an axis of rotation, said slickline drum having at least one bearing unit, said shaft of said coiled tubing assembly being received by said at least one bearing unit and extending through an interior of said slickline drum; and a swivel connection affixed to an end of said shaft adjacent said slickline drum, said swivel connection rotatable relative to said shaft, said swivel connection adapted to allow for introduction of a fluid or a cable into a hollow interior of said shaft.

17. The coiled tubing unit of claim 16, each of said coiled tubing assembly and slickline drum having a respective motor connected thereto and positioned on said base, the coiled tubing unit further comprising:

a skid having a hydraulic power unit thereon, said base being affixed to said skid, said hydraulic power unit having a first hydraulic hose connected to said motor of said coiled tubing assembly and a second hydraulic hose connected to said motor of said slickline drum.

18. The coiled tubing unit of claim 17, said base being removably affixed to said skid.

* * * * *